United States Patent [19]

Geiger

[11] Patent Number: 4,998,387

[45] Date of Patent: Mar. 12, 1991

[54] COVER ASSEMBLY FOR A GROUND OPENING

[76] Inventor: Robert A. Geiger, 356 W. Puce Rd. R.R. #1, Belle River, Ontario N0R 1A0, Canada

[21] Appl. No.: 411,651

[22] Filed: Sep. 25, 1989

[51] Int. Cl.[5] ..... E02D 29/14

[52] U.S. Cl. ..... 52/20; 52/21; 404/26

[58] Field of Search ..... 52/20, 21, 19; 404/25, 404/26

[56] References Cited

U.S. PATENT DOCUMENTS

| | | | |
|---|---|---|---|
| 2,930,295 | 3/1960 | Hale | 52/20 X |
| 3,408,778 | 11/1968 | Mason | 404/26 X |
| 3,926,533 | 12/1975 | Binette | 404/26 |
| 4,158,515 | 6/1979 | Helms | 52/20 X |
| 4,337,005 | 6/1982 | LeBaron | 404/26 |

FOREIGN PATENT DOCUMENTS

| | | | |
|---|---|---|---|
| 1162434 | 8/1969 | United Kingdom | 52/19 |

*Primary Examiner*—Richard E. Chilcot, Jr.
*Assistant Examiner*—Creighton Smith
*Attorney, Agent, or Firm*—Gifford, Groh, Sprinkle, Patmore and Anderson

[57] ABSTRACT

A cover assembly for a ground opening, such as a manhole or a storm drain, is disclosed. The cover assembly includes a frame having a top, a bottom and a tubular sidewall section which is open to both the top and the bottom of the frame. An abutment portion protrudes inwardly into the tubular sidewall section adjacent its bottom. A core is slidably insertable into the tubular sidewall section of the frame so that the bottom of the core abuts against the frame abutment portion. The core includes a tubular through opening adapted to receive and support a cover such as a manhole cover or a storm drain cover across its upper end. The frame is constructed of a metallic material while the core is constructed of a non-metallic material, such as plastic, to prevent seizing.

5 Claims, 1 Drawing Sheet

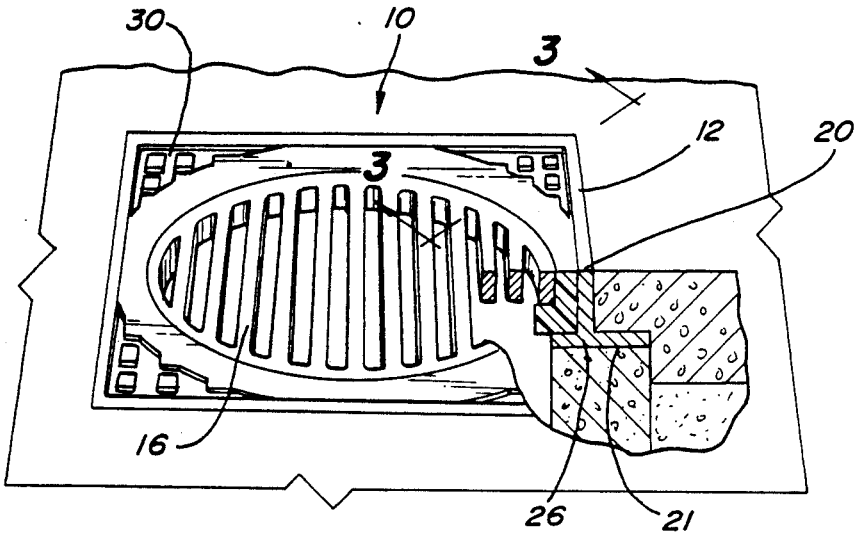
Fig-1
Fig-2
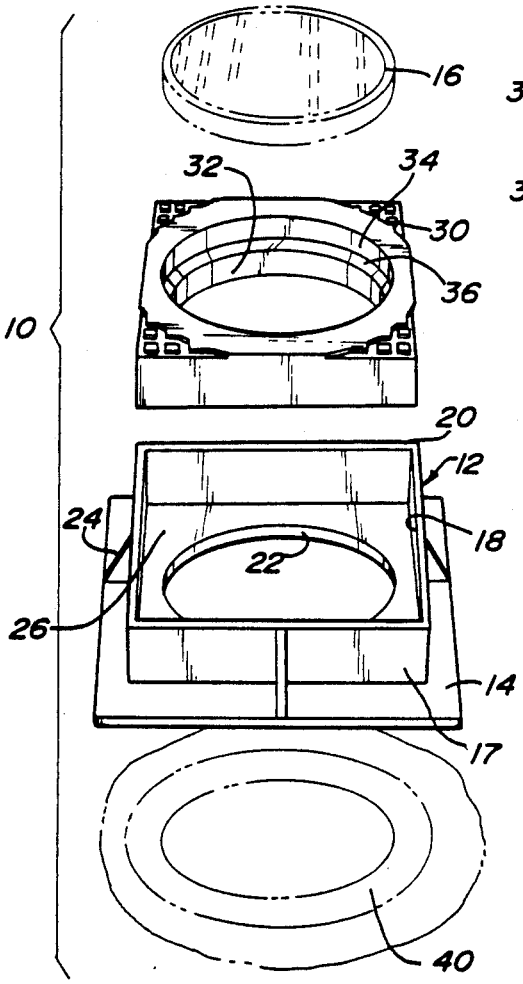
Fig-3
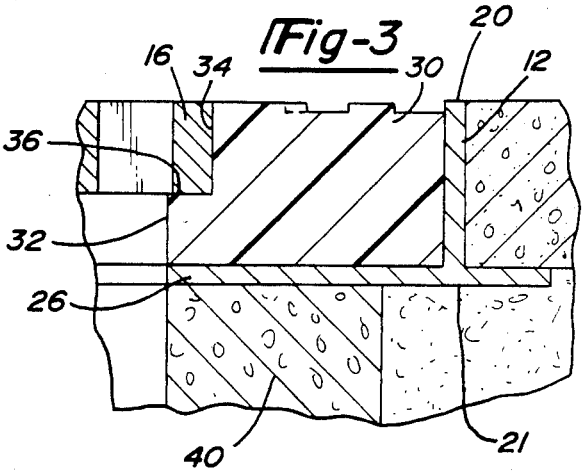
Fig-4
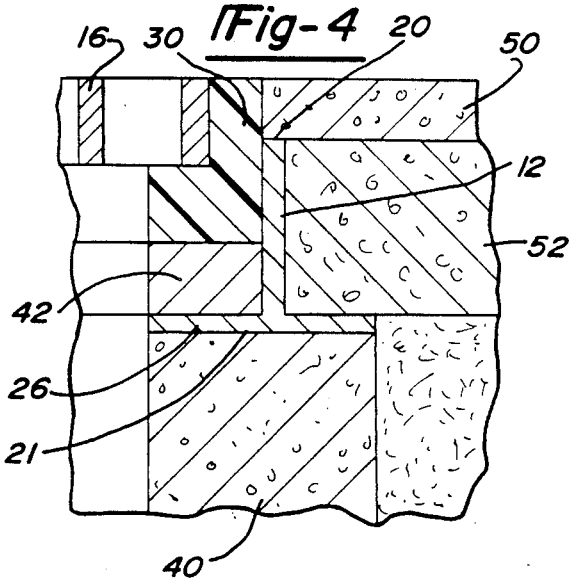

COVER ASSEMBLY FOR A GROUND OPENING

BACKGROUND OF THE INVENTION

I. Field of the Invention

The present invention relates generally to cover assemblies and, more particularly, to a cover assembly for a ground opening, such as a manhole or a storm drain.

II. Description of the Prior Art

The previously known cover assemblies for ground openings, such as manholes and storm drains, typically comprise a frame constructed of cast iron. The cast iron frame includes a circular opening adjacent its top. The frame is secured to the underground concrete manhole or storm drain construction by either cementing it or bolting it into place.

These previously known frames include an annular abutment surface adjacent their upper end. A manhole cover or storm drain cover is then positioned into the frame so that the annular abutment surface contacts and supports the cover adjacent the top of the frame. The manhole cover and storm drain cover (hereinafter collectively referred to as manhole cover) are also conventionally constructed of cast iron.

These previously known cover assemblies suffer several disadvantages. One primary disadvantage of these previously known assemblies is that the cover and/or frame may distort slightly after long exposure to both the elements and physical abuse. Since both the cover and the frame are constructed of cast iron, such distortion may cause the cover and frame to seize together. Once the cover and frame have seized together, the removal of the cover from the frame is not only time consuming, but it may be even necessary to destroy the cover and replace the cover with a new one.

A still further disadvantage of these previously known cover assemblies, and particularly manhole cover assemblies, is that the manhole cover must be at the same level as the street level. After time, however, many streets are repaved or resurfaced with asphalt which raises the level of the street, typically by one and one-half inches.

Once the level of the street has changed, it is often necessary to replace the entire manhole assembly. This procedure, of course, is not only time consuming but also very expensive. There have, however, been some manhole cover assemblies with means to adjust the vertical heighth of the manhole cover, but these manhole cover assemblies with such adjustment means are expensive and have not gained widespread acceptance.

SUMMARY OF THE PRESENT INVENTION

The present invention provides a cover assembly for a ground opening which overcomes all of the above mentioned disadvantages of the previously known devices.

In brief, the cover assembly of the present invention comprises a frame having a top, a bottom and a tubular sidewall section which is open to both the top and bottom of the frame. An annular abutment portion protrudes into the tubular sidewall section of the frame adjacent its bottom. Additionally, the frame is secured to the underground concrete manhole or storm drain structure by either cementing or bolting the frame in place. The frame is typically constructed of cast iron.

A non-metallic and preferably plastic core is then slidably insertable into the tubular sidewall section of the frame until the bottom of the core abuts against and is supported by the abutment portion of the frame. The core includes a through opening with an annular abutment surface adjacent its top. This annular abutment surface is adapted to receive and support a manhole or storm drain cover.

Since the core is constructed of a non-metallic material, any seizing between the core and the cover or the core and the frame is completely eliminated. Additionally, the vertical heighth of the core, and thus the effective vertical height of the manhole or storm drain cover, can be easily accomplished by placing shims between the bottom of the core and the frame abutment portion.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a fragmentary sectional elevational view showing a preferred embodiment of the present invention;

FIG. 2 is an exploded view of the preferred embodiment of the present invention;

FIG. 3 is a sectional view taken along line 3—3 in FIG. 1; and

FIG. 4 is a sectional view similar to the sectional portion of FIG. 1, but illustrating the use of a shim with the present invention.

DETAILED DESCRIPTION OF A PREFERRED EMBODIMENT OF THE PRESENT INVENTION

With reference first to FIGS. 1 and 2, a preferred embodiment of the cover assembly 10 of the present invention is thereshown and comprises a frame 12, a core 30 and a typically metal cover 16. The cover 16 shown in the drawing is a storm drain cover but it will be understood that it can also be a storm manhole cover. Each of these components will be described in greater detail.

With reference now especially to FIG. 2, the frame 12 comprises a generally rectangular base 14. A rectangular tubular sidewall section 17 extends upwardly from the base 14 and includes an interior wall 18 which is open to both a top 20 of the frame and the bottom 21 (FIG. 1) of the frame 12 through a circular opening 22. Strengthening ribs 24 also preferably extend between the sidewall section 17 and the frame base 14.

Referring again to FIGS. 1 and 2, an abutment portion 26 protrudes into the interior of the sidewall section 18 adjacent the bottom 21 of the frame 12. The circular opening 22 is formed through this abutment portion 26.

Referring now especially to FIGS. 2 and 3, the core 30 is dimensioned so that it is slidably removably received within the tubular sidewall section 17 of the frame 12. Unlike the frame 12 which is constructed of cast iron, however, the core 30 is constructed of a non-metallic material, such as plastic.

The core 30 also includes a circular throughbore 32 having an enlarged diameter portion 34 adjacent its top. The enlarged diameter portion 34 forms an annular abutment surface 36 adjacent the top of the core 30.

In operation, the frame 12 is secured to an underground manhole or storm drain structure 40 by cementing, bolting or in any other conventional fashion. Thereafter, the non-metallic core 30 is slidably inserted into the tubular sidewall section 17 of the frame 12 until the core 30 abuts against the abutment portion 26 of the frame 12.

Thereafter, the circular cover 16, such as a manhole or storm drain cover, is positioned within the top of the core 30 so that the cover 16 abuts against and is supported by the annular abutment surface 36 on the core 30. In doing so, the top of the cover 16 is essentially flush with the top of the core 30 as best shown in FIG. 3.

In practice, the effective heighth of the manhole or storm drain cover 16 can be effectively changed by changing the vertical position of the core 30 with respect to the frame 12. This can be accomplished by placing shims 42 in between the abutment portion 26 of the frame 12 and the bottom of the core 30 as best shown in FIG. 4.

A still further advantage of the present invention is that, due to the metallic, non-metallic, metallic construction of the frame 12, core 30 and cover 16, seizing between the cover 16 and the core 30 is completely eliminated.

A still further advantage of the present invention is that the effective height of the cover 16 can be raised as shown in FIG. 4. This is particularly useful when resurfacing of the road, as shown at 50 in FIG. 4, raises the effective height of the road 52.

Having described my invention, however, many modifications thereto will become apparent to those skilled in the art to which it pertains without deviation from the spirit of the invention as defined by the scope of the appended claims.

I claim:

1. A cover assembly for a ground opening comprising:

a cover, a frame, said frame having a top, a bottom and a tubular sidewall section, said sidewall section having an interior wall open to said top and said bottom, said frame having an abutment portion which protrudes into said tubular sidewall section adjacent the bottom of said frame, a core, said core being slidably insertable into said tubular sidewall section of said frame so that a bottom of said core abuts against said abutment portion, said core having a tubular through opening and an inwardly extending annular abutment surface at a midpoint of said core through opening, said core annular abutment surface being dimensioned to receive and support said cover across an upper end of said core so that a bottom of said cover is spaced upwardly from said frame abutment portion, means for adjusting the vertical position of said core with respect to said frame comprising at least one shim inserted between said frame abutment portion and a bottom of said core.

wherein said frame is constructed of metal, wherein said core is constructed of a non-metallic material.

2. The invention as defined in claim 1 wherein said core is constructed of plastic.

3. The invention as defined in claim 1 wherein said tubular section is cylindrical in shape.

4. The invention as defined in claim 1 wherein said core assembly is a manhole assembly.

5. The invention as defined in claim 1 wherein said drain assembly is a storm drain assembly, and wherein said cover includes a plurality of openings formed through it.

* * * * *